US007005244B2

(12) United States Patent
Park et al.

(10) Patent No.: US 7,005,244 B2
(45) Date of Patent: Feb. 28, 2006

(54) METHOD OF MANUFACTURING MONOLITHIC INKJET PRINTHEAD

(75) Inventors: Byung-ha Park, Suwon-si (KR); Myong-jong Kwon, Suwon-si (KR); Young-ung Ha, Suwon-si (KR); Sung-joon Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/917,343

(22) Filed: Aug. 13, 2004

(65) Prior Publication Data

US 2005/0067376 A1 Mar. 31, 2005

(30) Foreign Application Priority Data

Sep. 27, 2003 (KR) ..... 10-2003-0067142

(51) Int. Cl.
*B41J 2/16* (2006.01)

(52) U.S. Cl. ..... 430/320; 216/27

(58) Field of Classification Search ..... None
See application file for complete search history.

(56) References Cited

U.S. PATENT DOCUMENTS 6,409,312 B1 * 6/2002 Mrvos et al. ..... 347/54
6,482,574 B1 * 11/2002 Ramaswami et al. ..... 430/320
2004/0070643 A1 * 4/2004 Kubota et al. ..... 347/20

* cited by examiner

*Primary Examiner*—John A. McPherson
(74) *Attorney, Agent, or Firm*—Stanzione & Kim, LLP

(57) ABSTRACT

A method of manufacturing a monolithic inkjet printhead. The method may include forming on a substrate a heater for heating ink and an electrode for supplying current to the heater, forming a passage forming layer that surrounds an ink passage by applying negative-type photoresist to the substrate and patterning the same, forming a sacrificial layer having a planarized top surface in a space surrounded by the passage forming layer by repeatedly applying a positive-type photoresist to the substrate having the passage forming layer and patterning the same by photolithography at least twice, forming a nozzle layer having a nozzle by applying a negative-type photoresist to the passage forming layer and the sacrificial layer and patterning the same, etching the substrate from the bottom surface thereof to be perforated and forming an ink supply hole, and removing the sacrificial layer. Since the top surface of the sacrificial layer is planarized, the shape and dimension of the ink passage can be easily controlled, thereby improving uniformity of the ink passage.

26 Claims, 14 Drawing Sheets

METHOD OF MANUFACTURING MONOLITHIC INKJET PRINTHEAD

CROSS-REFERENCE TO RELATED APPLICATIONS

This application claims the priority of Korean Patent Application No. 2003-67142, filed on Sep. 27, 2003, in the Korean Intellectual Property Office, the disclosure of which is incorporated herein in its entirety by reference.

BACKGROUND OF THE INVENTION

1. Field of the Invention

The present general inventive concept relates to a method of manufacturing an ink-jet printhead, and more particularly, to a method of manufacturing a monolithic inkjet printhead by photolithography using a photoresist.

2. Description of the Related Art

In general, inkjet printheads are devices for printing a predetermined color image by ejecting small droplets of printing ink at a desired position on a recording sheet. Ink ejection mechanisms of an inkjet printer are generally categorized into two different types: a thermally-driven type, in which a heat source is employed to form bubbles in ink thereby causing an ink droplet to be ejected, and a piezoelectrically-driven type, in which an ink droplet is ejected by a change in ink volume due to deformation of a piezoelectric element.

A typical structure of a thermally-driven inkjet printhead is shown in FIG. 1. Referring to FIG. 1, an inkjet printhead includes a substrate 10, a passage forming layer 20 stacked on the substrate 10, and a nozzle layer 30 which is formed on the passage forming layer 20. An ink supply hole 51 is formed in the substrate 10. The passage forming layer 20 has an ink chamber 53 storing ink, and a restrictor 52 connecting the ink supply hole 51 and the ink chamber 53. The nozzle layer 30 has a nozzle 54 through which the ink is ejected from the ink chamber 53. Also, a heater 41 for heating ink in the ink chamber 53 and an electrode 42 for supplying current to the heater 41 are provided on the substrate 10.

The ink ejection mechanism of the conventional thermally-driven inkjet printhead having the above-described configuration will now be described. Ink is supplied from an ink reservoir (not shown) to the ink chamber 53 through the ink supply hole 51 and the restrictor 52. The ink filling the ink chamber 53 is heated by a heater 41 consisting of resistive heating elements. The ink boils to form bubbles which expand so that the ink in the ink chamber 53 is ejected by a bubble pressure. Accordingly, the ink in the ink chamber 53 is ejected outside the ink chamber 53 through the nozzle 54 in the form of ink droplets.

The conventional thermally-driven inkjet printhead having the above-described configuration can be monolithically manufactured by photolithography, and the manufacturing process thereof is illustrated in FIGS. 2A through 2E.

Referring to FIG. 2A, a substrate 10 having a predetermined thickness is prepared, and a heater 41 for heating ink and an electrode 42 for supplying a current to the heater 41 are formed on the substrate 10.

As shown in FIG. 2B, a negative-type photoresist is applied to the entire surface of the substrate 10 to a predetermined thickness, and patterned in such a shape as to surround an ink chamber and a restrictor by photolithography, thereby forming a passage forming layer 20.

As shown in FIG. 2C, a space surrounded by the passage forming layer 20 is filled with positive-type photoresist, thereby forming a sacrificial layer S. In detail, the positive-type photoresist is applied to the entire surface of the substrate 10 to a predetermined thickness, and patterned, thereby forming a sacrificial layer S. Here, the positive-type photoresist is generally applied by spin coating, and the top surface of the applied positive-type photoresist is not planarized due to the centrifugal force. In other words, the positive-type photoresist bulges upward around the passage forming layer 20 due to the centrifugal force during spin coating, as indicated by the double-dashed line shown in FIG. 2C. If the uneven surface of the positive-type photoresist is patterned, the sacrificial layer S protrudes upward at its peripheral edges.

As shown in FIG. 2D, negative-type photoresist is applied to the passage forming layer 20 and the sacrificial layer S to a predetermined thickness, and patterned by photolithography, thereby forming a nozzle layer 30 having a nozzle 54.

Subsequently, as shown in FIG. 2E, the bottom surface of the substrate 10 is wet-etched to form an ink supply hole 51, and the sacrificial layer S is removed through the ink supply hole 51, thereby forming a restrictor 52 and an ink chamber 53 in the passage forming layer 20.

Referring back to FIG. 2D, when forming the nozzle layer 30 by applying negative-type photoresist to the sacrificial layer S, a projecting edge of the sacrificial layer S made of positive-type photoresist may react with a solvent contained in the negative-type photoresist, causing deformation or melting. Then, as shown in FIG. 2E, a cavity C is formed between the passage forming layer 20 and the nozzle layer 30.

FIG. 3 is a scanning electron microscope (SEM) photograph of a conventional inkjet printhead. Referring to FIG. 3, the passage forming layer 20 and the nozzle layer 30 are not perfectly adhered to each other due to existence of the cavity C formed between the passage forming layer 20 and the nozzle layer 30.

As described above, according to the conventional manufacturing method of an inkjet printhead, since the shape and dimension of the ink passage are not easily controlled, it is difficult to attain uniformity of the ink passage, and ink ejection performance of the printhead may deteriorate. Further, since the passage forming layer 20 and the nozzle layer 30 are not perfectly adhered to each other, the durability of the inkjet printhead is lowered.

Referring back to FIG. 2D, the negative-type photoresist applied to the sacrificial layer S is patterned by exposure, development and baking. During exposure, broadband UV light, including I-line (353 nm), H-line (405 nm) and G-line (436 nm), is usually used. Here, the H-line and G-line having a relatively long wavelength has a long penetration depth, affect both the negative-type photoresist forming the nozzle layer 30 and the positive-type photoresist forming the sacrificial layer S disposed under the nozzle layer 30. Also, when the positive photoresist which is most widely used is irradiated with UV light, a photosensitizer contained therein may be decomposed by light, producing nitrogen ($N_2$) gas. The produced nitrogen gas expands during baking to lift the nozzle layer 30, resulting in deformation of the nozzle layer 30.

FIG. 4A is a plan view showing a state in which bubbles are generated in the sacrificial layer, and FIG. 4B is a photograph showing a cross section of a portion where the bubbles are generated. Referring to FIGS. 4A and 4B, nitrogen gas is generated in the sacrificial layer S made of the positive-type photoresist, and the nozzle layer 30 has deformed due to the nitrogen gas.

SUMMARY OF THE INVENTION

The present general inventive concept provides a method of manufacturing a monolithic inkjet printhead which can easily control the shape and dimension of the ink passage by planarizing the top surface of a sacrificial layer, thereby improving uniformity of the ink passage.

Additional aspects and advantages of the present general inventive concept will be set forth in part in the description which follows and, in part, will be obvious from the description, or may be learned by practice of the general inventive concept.

A method of manufacturing a monolithic inkjet printhead, the method including forming an ink heating member on a substrate to heat ink, forming a passage forming layer that surrounds an ink passage by applying a negative-type photoresist pattern to the substrate, forming a sacrificial layer having a planarized top surface in a space surrounded by the passage forming layer by repeatedly applying a positive-type photoresist pattern to the substrate having the passage forming layer, forming a nozzle layer having a nozzle by applying a negative-type photoresist pattern to the passage forming layer and the sacrificial layer, perforating a bottom portion of the substrate to form an ink supply hole, and removing the sacrificial layer.

In aspect of the present general inventive concept, each of the positive-type photoresist patterns may be formed by a photolithography process.

In another aspect of the present general inventive concept, the perforating of the bottom portion of the substrate may be performed by an etching process.

In another aspect of the present general inventive concept, the forming of the passage forming layer may include applying a first negative-type photoresist layer on an entire surface of the substrate, exposing the first photoresist layer in an ink passage pattern, and removing the non-exposed portions of the first photoresist layer.

In another aspect of the present general inventive concept, the ink passage pattern may be formed using a first photomask.

In another aspect of the present general inventive concept, the sacrificial layer may be formed to have substantially the same height as the passage forming layer.

In another aspect of the present general inventive concept, the forming of the sacrificial layer may include applying a first positive-type photoresist layer on the entire surface of the substrate having the passage forming layer, exposing portions of the first positive-type photoresist layer in an ink passage pattern, removing the exposed portions of the first positive-type photoresist layer, applying a second positive-type photoresist layer to the entire surface of the substrate having the passage forming layer and the first positive-type photoresist layer, exposing portions the second positive-type photoresist layer in an ink passage pattern, removing the exposed portions of the second positive-type photoresist layer, blank-exposing the second positive-type photoresist layer and the first positive-type photoresist layer to have the same height as that of the passage forming layer, and removing the exposed portions of the second positive-type photoresist layer and the first positive-type photoresist layer.

In another aspect of the present general inventive concept, the ink passage pattern may be formed using a second photomask.

In another aspect of the present general inventive concept, the forming of the sacrificial layer may include applying a first positive-type photoresist layer to the entire surface of the substrate having the passage forming layer, exposing portions the first positive-type photoresist layer in an ink passage pattern, removing the exposed portions of the first positive-type photoresist layer layer, applying a second positive-type photoresist layer to the entire surface of the substrate having the passage forming layer and the first positive-type photoresist layer, blank-exposing the second positive-type photoresist layer and the first positive-type photoresist layer to have the same height of the passage forming layer, removing exposed portions of the second positive-type photoresist layer and the first positive-type photoresist layer, exposing portions of the second positive-type photoresist layer in an ink passage pattern, and removing the exposed portions of the second positive-type photoresist layer.

In another aspect of the present general inventive concept, the ink passage pattern may be formed using a second photomask.

In another aspect of the present general inventive concept, the forming of the sacrificial layer may include applying a first positive-type photoresist layer to the entire surface of the substrate having the passage forming layer, exposing portions of the first positive-type photoresist layer in an ink passage pattern, removing the exposed portions of the first positive-type photoresist layer, applying a second positive-type photoresist layer to the entire surface of the substrate having the passage forming layer and the first positive-type photoresist layer, exposing portions of the second positive-type photoresist layer in an ink passage pattern, blank-exposing the second positive-type photoresist layer and the first positive-type photoresist layer to have the same height as that of the top surface of the passage forming layer, and removing the exposed portions of the second positive-type photoresist layer and the first positive-type photoresist layer.

In another aspect of the present general inventive concept, the ink passage pattern may be formed using a second photomask.

In another aspect of the present general inventive concept, the forming of the sacrificial layer may include applying a first positive-type photoresist layer to the entire surface of the substrate having the passage forming layer, exposing portions of the first positive-type photoresist layer in an ink passage pattern, removing the exposed portions the first positive-type photoresist layer, applying a second positive-type photoresist layer to the entire surface of the substrate having the passage forming layer and the first positive-type photoresist layer, blank-exposing the second positive-type photoresist layer and the first positive-type photoresist layer to have the same height as that of the top surface of the passage forming layer, exposing the second positive-type photoresist layer in an ink passage pattern, and removing the exposed portions of the second positive-type photoresist layer and the first positive-type photoresist layer.

In another aspect of the present general inventive concept, the ink passage pattern may be formed using a second photomask.

In another aspect of the present general inventive concept, the applying of the positive-type photoresist may be performed by spin coating.

In another aspect of the present general inventive concept, the sacrificial layer may be formed using an imide-based positive-type photoresist to have a height greater than the passage forming layer.

In another aspect of the present general inventive concept, the forming of the sacrificial layer may include applying a first imide-based positive-type photoresist layer to the entire surface of the substrate having the passage forming layer, exposing portions of the first sacrificial layer in an ink passage pattern, removing the exposed portions of the first imide-based positive-type photoresist layer, applying an second imide-based positive-type photoresist layer to the entire surface of the substrate having the passage forming layer and the first imide-based positive-type photoresist layer, exposing portions of the second imide-based positive-type photoresist layer in an ink passage pattern, and removing the exposed portions of the second sacrificial layer.

In another aspect of the present general inventive concept, the ink passage pattern may be formed using a second photomask.

In another aspect of the present general inventive concept, the applying of the imide-based positive-type photoresist may be performed by spin coating.

In another aspect of the present general inventive concept, the forming of the nozzle layer may include applying a second negative-type photoresist layer to the passage forming layer and the sacrificial layer, exposing portions of the second negative-type photoresist layer in a nozzle pattern, and removing the unexposed portions the second negative-type photoresist layer to form a nozzle and a nozzle layer.

In another aspect of the present general inventive concept, the nozzle pattern may be formed using a third photomask.

In another aspect of the present general inventive concept, during the exposing of the second photoresist layer, a UV beam not longer than an I-line radiation, an e-beam, or an X-ray may be used.

In another aspect of the present general inventive concept, the etching the substrate may include applying a photoresist layer to a rear surface of the substrate, patterning the photoresist in the ink supply hole form, and etching the rear surface of the substrate at the ink supply hole form to form an ink supply hole.

In another aspect of the present general inventive concept, the ink supply hole form may be formed by using an etch mask.

In another aspect of the present general inventive concept, the etching of the rear surface of the substrate may be performed by dry etching using plasma.

In another aspect of the present general inventive concept, the etching of the rear surface of the substrate may be performed by wet etching using tetramethyl ammonium hydroxice (TMAH) or KOH.

According to the present general inventive concept, since the top surface of the sacrificial layer is planarized, the shape and dimension of the ink passage can be easily controlled, thereby improving uniformity of the ink passage. Also, since gas is not generated in the sacrificial layer, deformation of the nozzle layer due to gas can be avoided.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
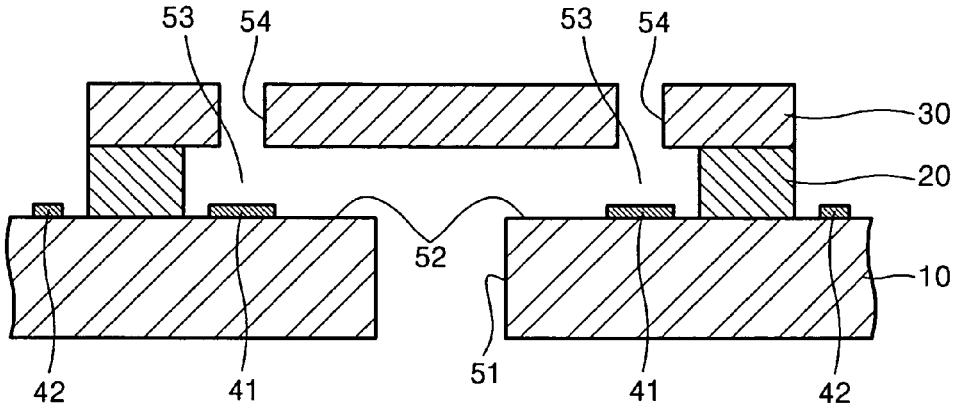
FIG. 1 (PRIOR ART)
FIG. 1 is a schematic perspective view illustrating the structure of a conventional thermally-driven inkjet printhead.
Figure 2A:
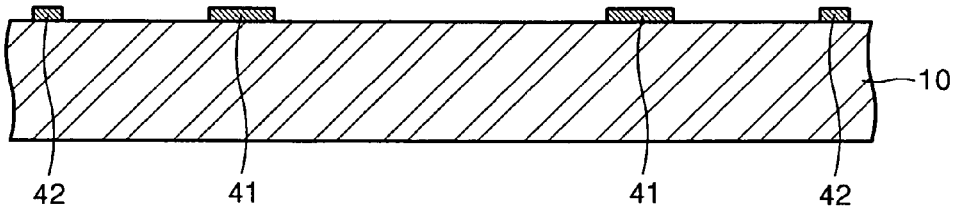
FIG. 2A (PRIOR ART)
FIGS. 2A through 2E are cross-sectional views illustrating a method of manufacturing the conventional inkjet printhead shown is FIG. 1.
Figure 2B:
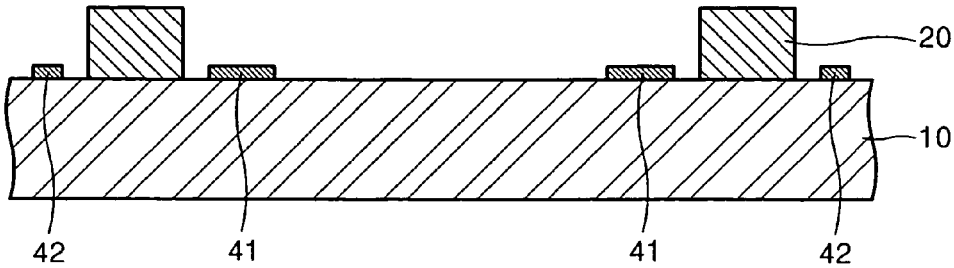
FIG. 2B (PRIOR ART)
Figure 2C:
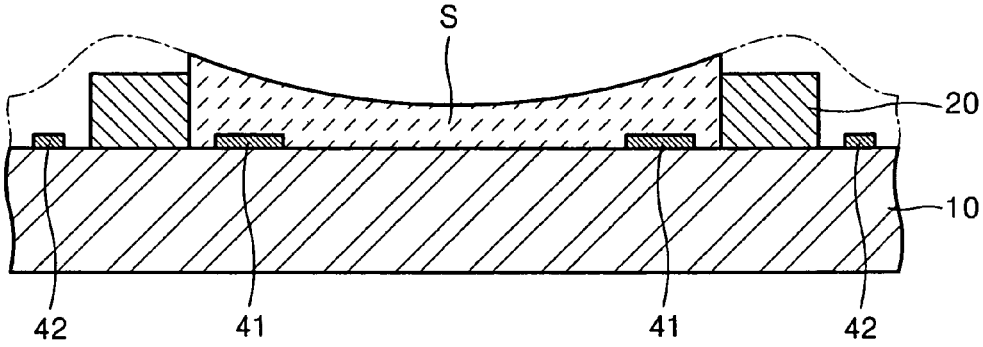
FIG. 2C (PRIOR ART)
Figure 2D:
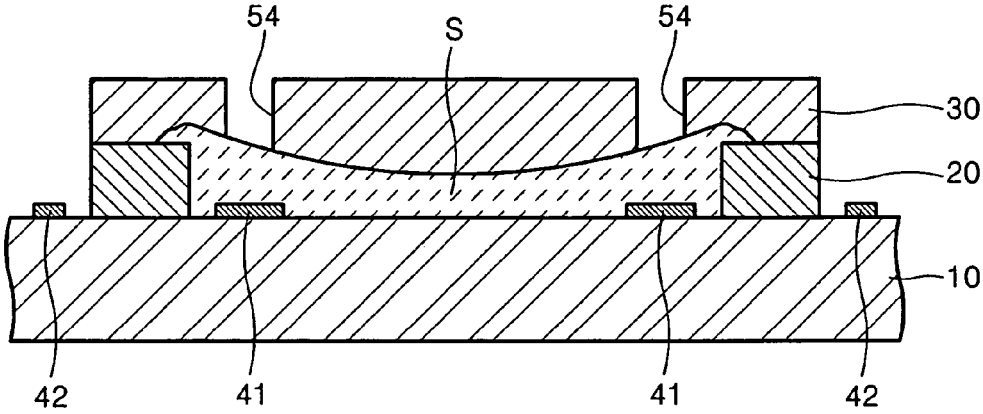
FIG. 2D (PRIOR ART)
Figure 2E:
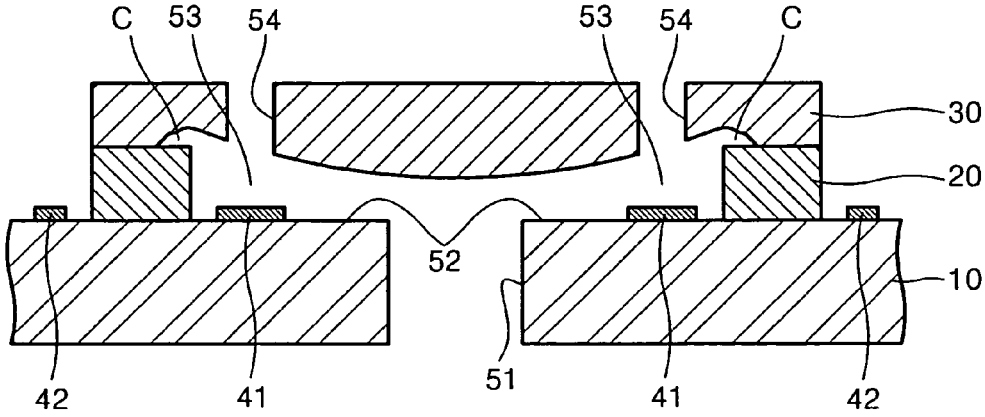
FIG. 2E (PRIOR ART)
Figure 3:
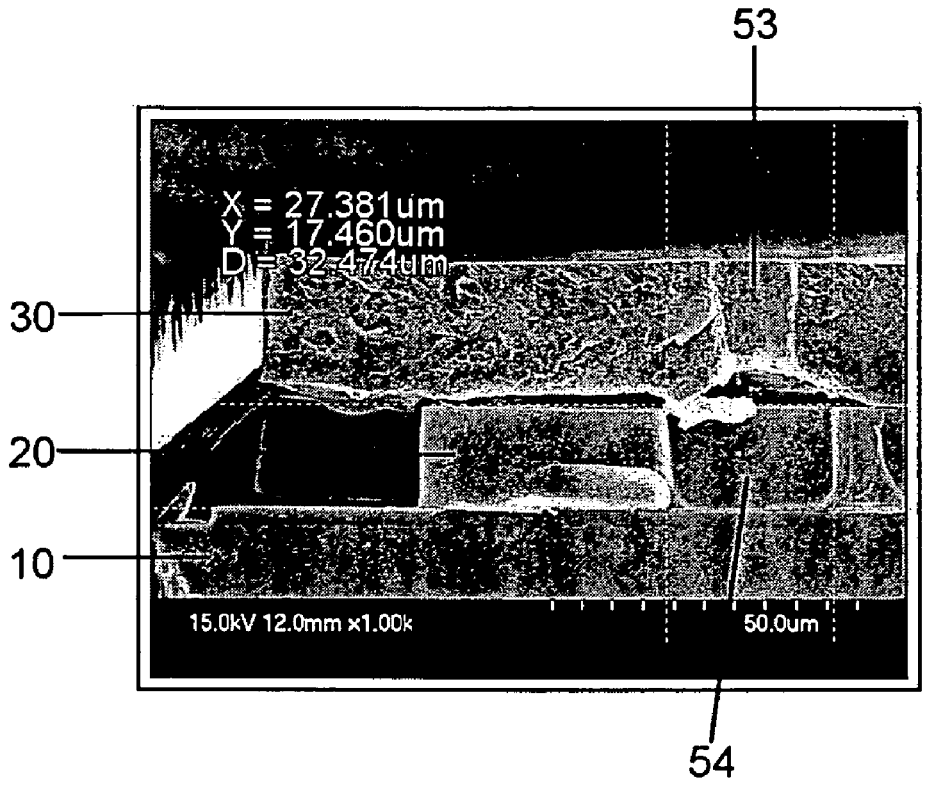
FIG. 3 (PRIOR ART)
FIG. 3 is a scanning electron microscope (SEM) photograph of a conventional inkjet printhead shown in FIG. 1.
Figure 4A:
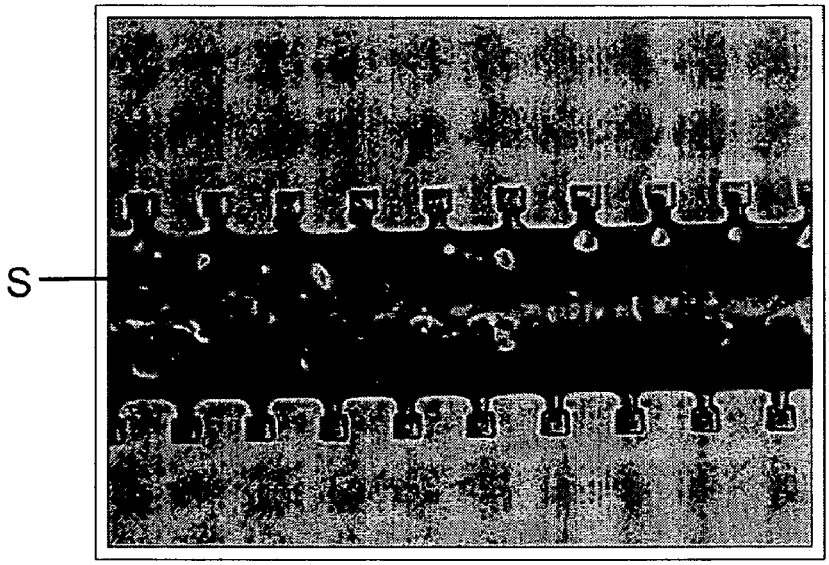
FIG. 4A (PRIOR ART)
FIG. 4A is a cross-sectional view showing a state in which bubbles are generated in a sacrificial layer and FIG. 4B is a cross-sectional view showing a portion where the bubbles are generated.
Figure 4B:
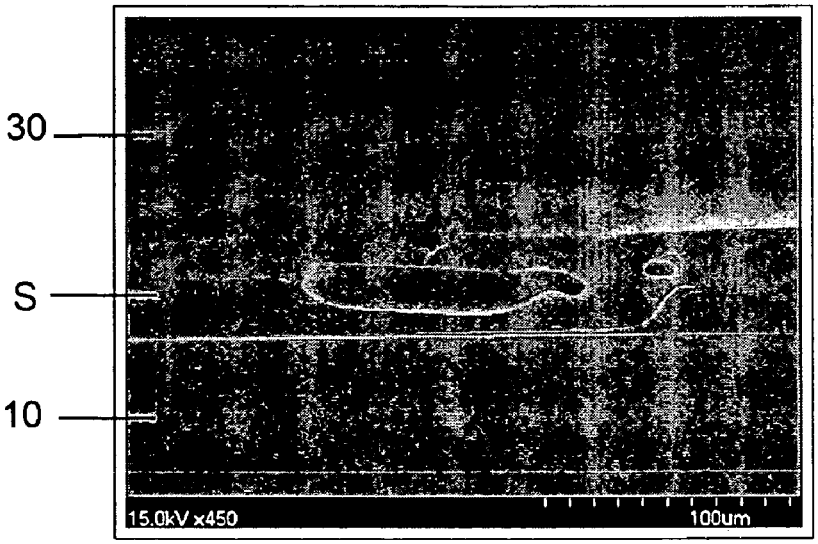
FIG. 4B (PRIOR ART)

Hereinafter, methods of manufacturing a monolithic inkjet printhead according to exemplary embodiments of the present general inventive concept will be described in detail with reference to the accompanying drawings.

The following examples are given for the purpose of illustration and not of limitation. In the accompanying drawings, like reference numerals refer to the like elements throughout, and the shape of elements is exaggerated for clarity. Further, it will be understood that when a layer is referred to as being "on" another layer or substrate, it can be directly-on the other layer or substrate, or intervening layers may also be present.

Although only a small portion of a silicon wafer is shown in the drawings below, the inkjet printhead may be one of tens or hundreds of chips produced from the single wafer.

Figure 5A:
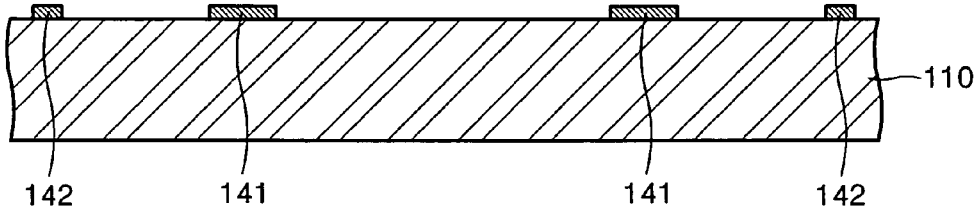
FIGS. 5A through 5R are cross-sectional views illustrating a method of manufacturing a monolithic inkjet printhead according to an embodiment of the present general inventive concept.
Figure 5B:
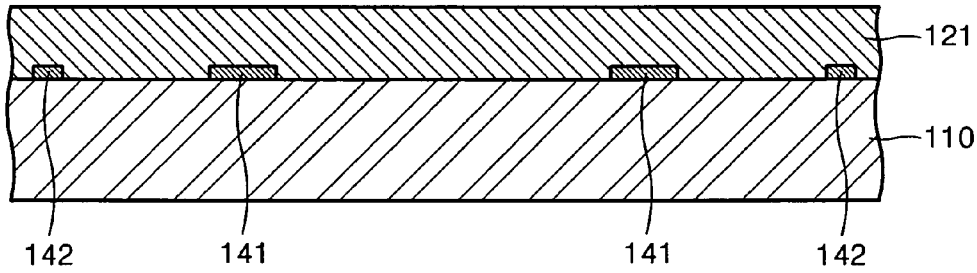
Figure 5C:
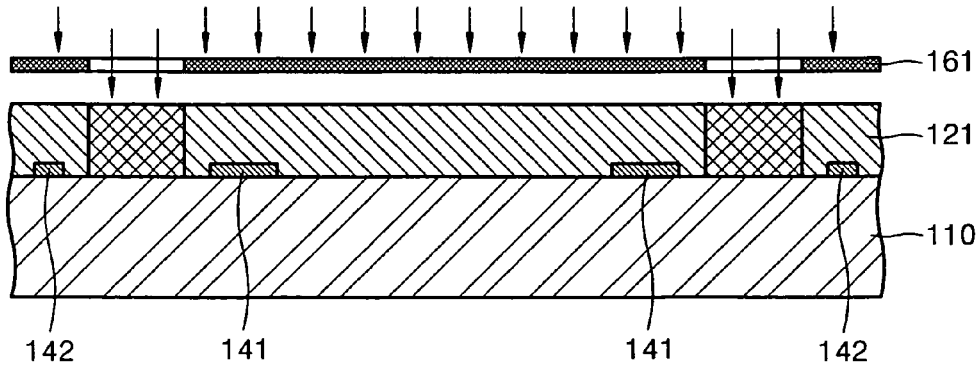
Figure 5D:
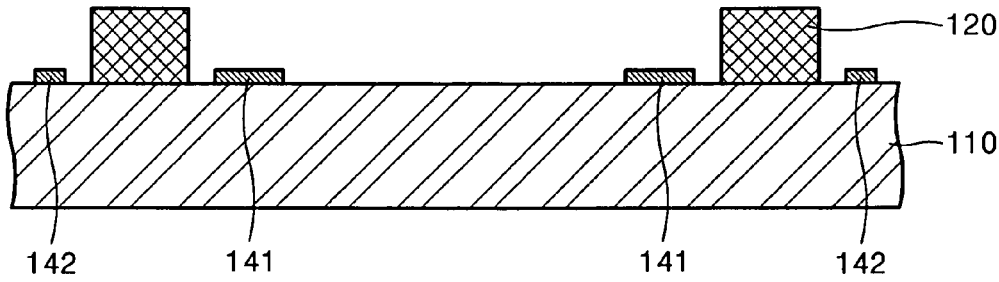
Figure 5E:
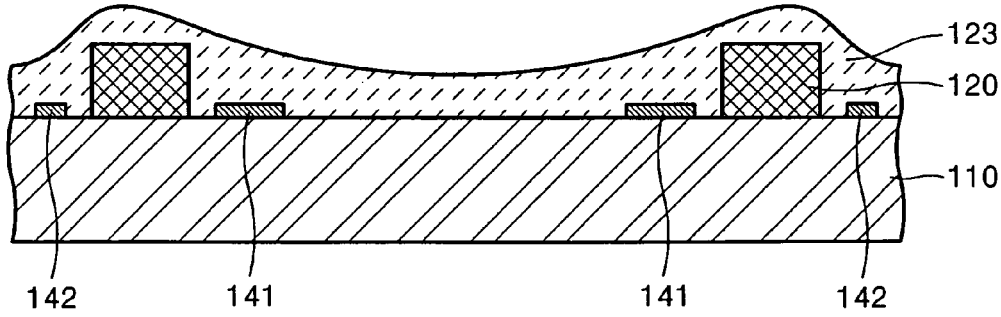
Figure 5F:
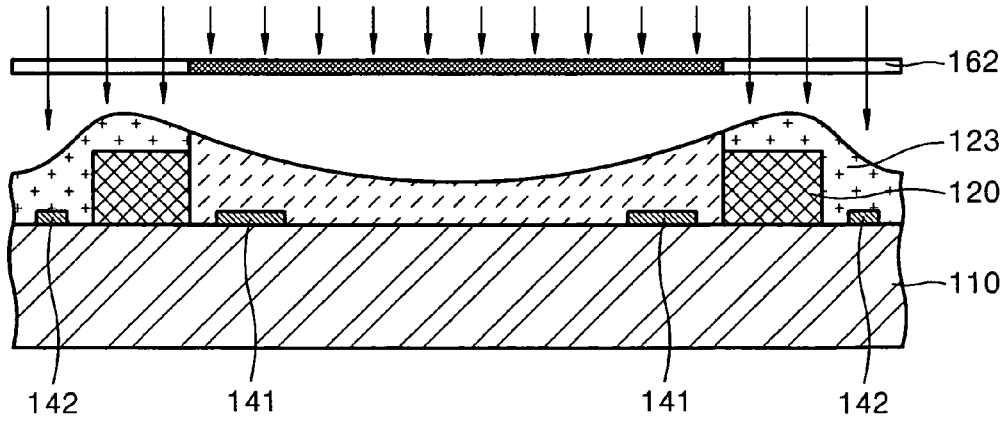
Figure 5G:
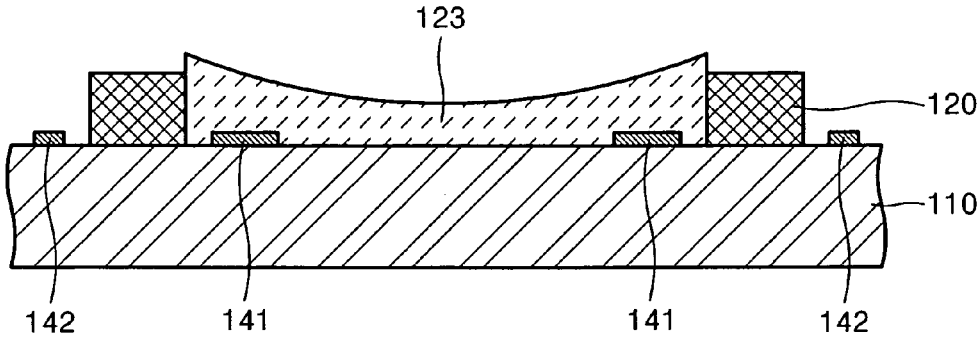
Figure 5H:
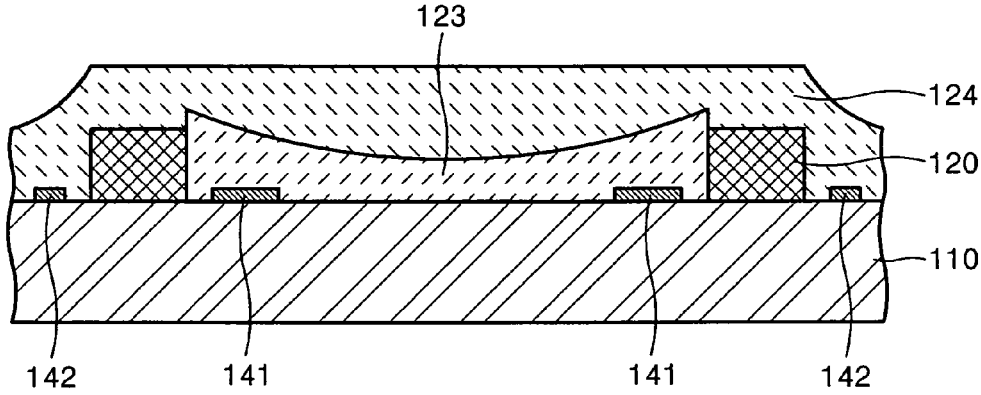
Figure 5I:
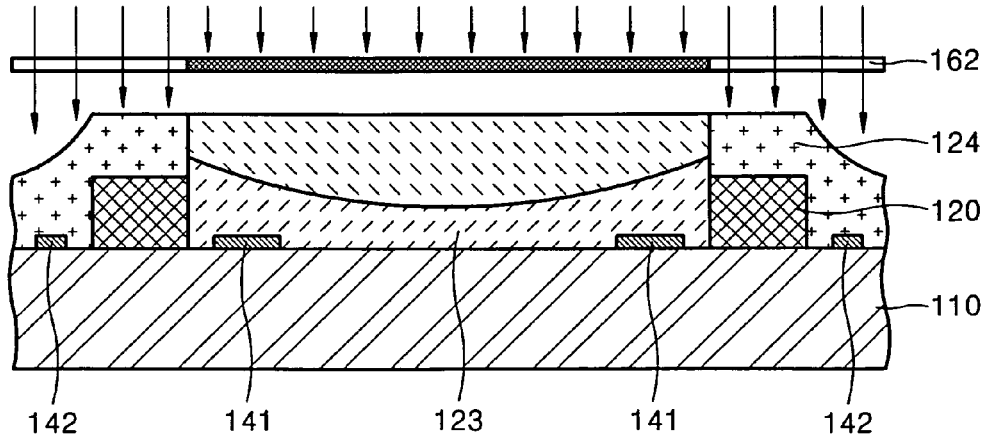
Figure 5J:
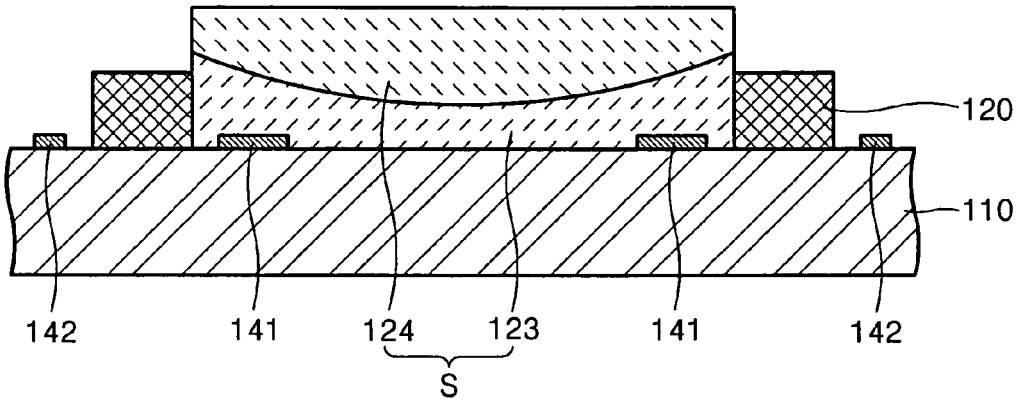
Figure 5K:
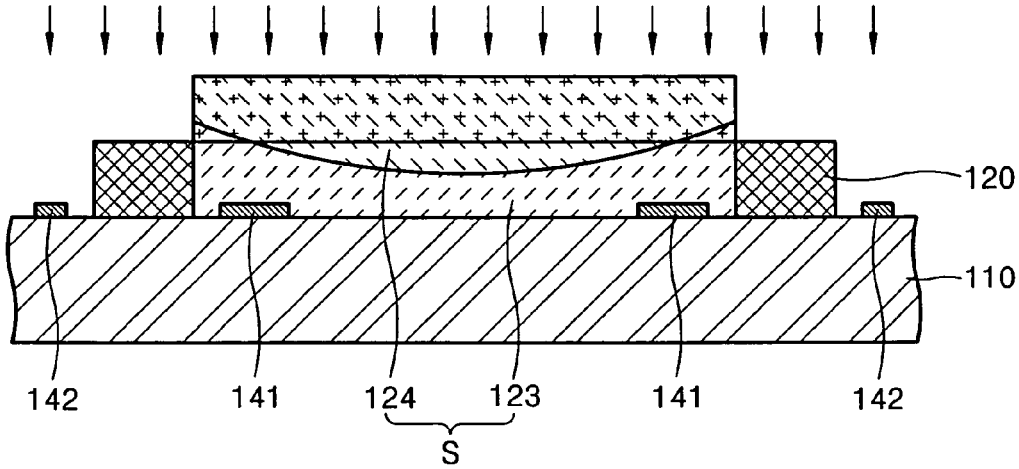
Figure 5L:
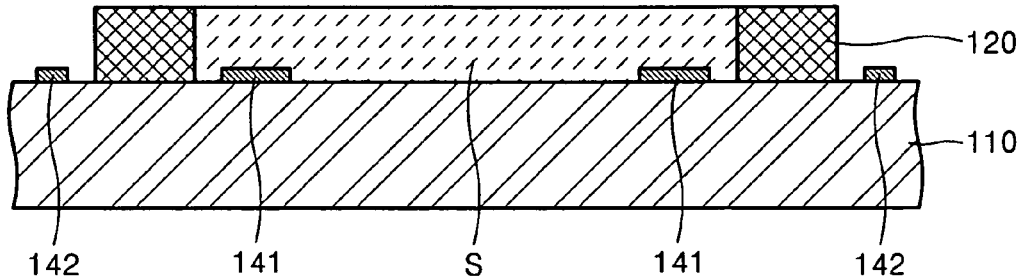
Figure 5M:
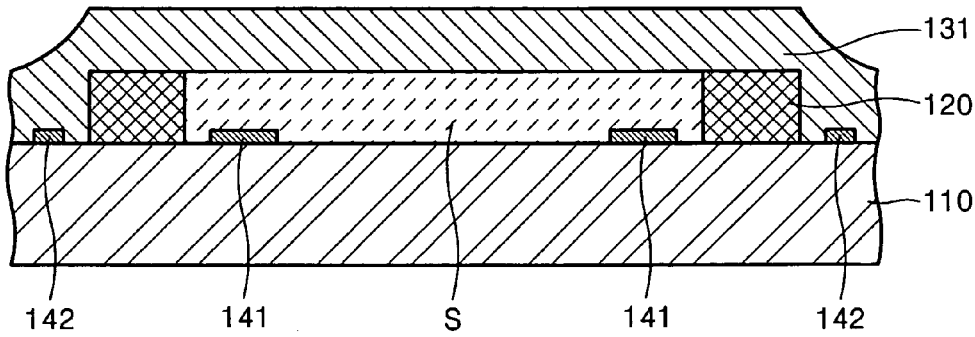
Figure 5N:
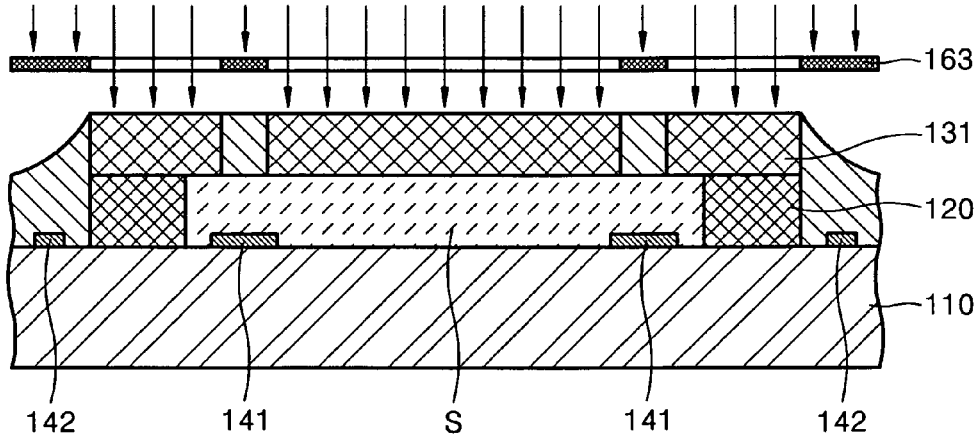
Figure 5O:
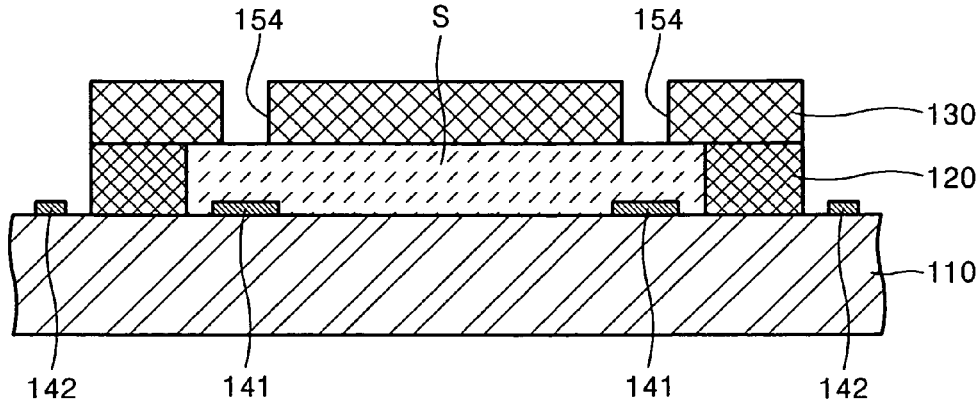
Figure 5P:
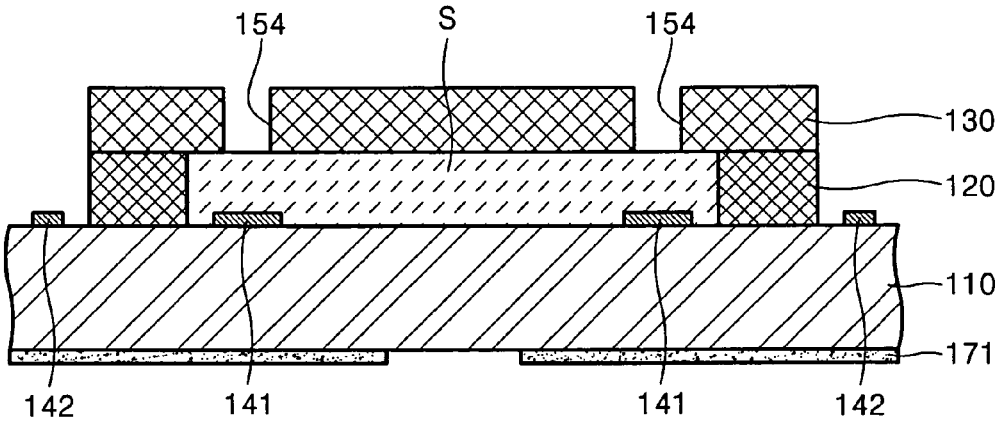
Figure 5Q:
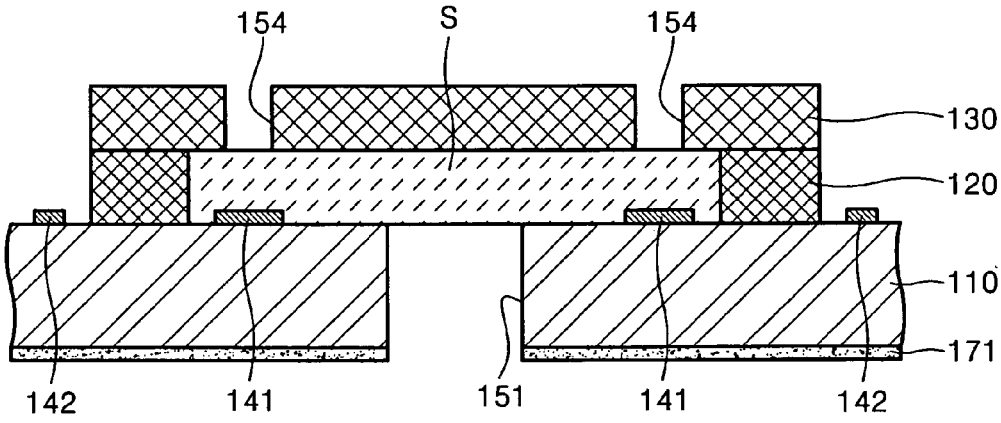
Figure 5R:
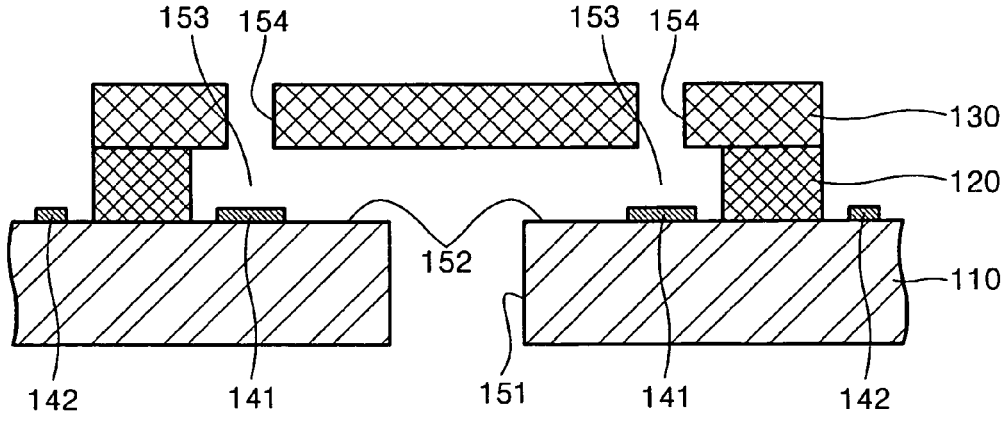

FIGS. 5A through 5R are cross-sectional views showing a method of manufacturing a monolithic inkjet printhead according to an embodiment of the present general inventive concept.

As shown in FIG. 5A, a heater 141 that heats ink and an electrode 142 that supplies current to the heater 141 are formed on a substrate 110. Here, a silicon wafer, which is widely used in manufacturing semiconductor devices and is advantageous for mass production, is typically used as the substrate 110.

The heater 141 may be formed by depositing a resistive heating material, such as tantalum-nitride or a tantalum-aluminum alloy, by sputtering or chemical vapor deposition (CVD), and patterning the same. The electrode 142 may be formed by depositing a metal having good conductivity, such as aluminum or an aluminum alloy, by sputtering, and patterning the same. Although not shown, a passivation layer made of silicon oxide or silicon nitride may be formed on the heater 141 and the electrode 142.

As shown in FIG. 5B, a first photoresist layer 121 may be formed on the substrate 110 where the heater 141 and the electrode 142 are formed. Since the first photoresist layer 121 forms a passage forming layer (120 of FIG. 5D) surrounding an ink chamber and a restrictor (120 of FIG. 5D), which will later be described, it is formed of a negative-type photoresist that is chemically stable against ink. In particular, the first photoresist layer 121 is formed by applying negative-type photoresist to a predetermined thickness to an entire surface of the substrate 110. Here, the negative-type photoresist may be applied to a thickness corresponding to a height of the ink chamber so as to accommodate the quantity of ink droplets ejected. The negative-type photoresist may be applied to the substrate 110 by spin coating. The above-described method can also be applied to a coating technique to be described below.

As shown in FIG. 5C, a first photoresist layer 121 made of the negative-type photoresist is exposed to ultraviolet (UV) light using a first photomask 161 having an ink chamber and a restrictor pattern. In the exposing operation, a portion of the first photoresist layer 121 exposed to UV is hardened so as to have chemical resistance and high mechanical strength, while an unexposed portion is easily dissolved in a developer.

Then, the first photoresist layer 121 is developed to remove the unexposed portion, forming a space, and the portion exposed to be hardened remains, forming a passage forming layer 120 as shown in FIG. 5D.

FIGS. 5E through 5I illustrate operations of forming a sacrificial layer S in the space surrounded by the passage forming layer 120. In the present general inventive concept, the sacrificial layer S will have a planarized top surface by two operations of applying a positive-type photoresist and one operation of planarizing the top surface.

In more detail, as shown in FIG. 5E, the positive-type photoresist is applied to the entire surface of the substrate 110 having the passage forming layer 120 to a predetermined thickness by spin-coating, thereby forming a first sacrificial layer 123. Here, the positive-type photoresist bulges upward due to the protruding passage forming layer 120, making the top surface of the first sacrificial layer 123 uneven. As shown in FIG. 5F, the first sacrificial layer 123 is exposed to ultraviolet (UV) light using a second photomask 162 having an ink chamber and a restrictor pattern. In the exposing operation, a portion of the first sacrificial layer 123 made of the positive-type photoresist exposed to UV becomes easily dissolved in a developer. Thus, when the first sacrificial layer 123 is developed, only an unexposed portion of the first sacrificial layer 123 remains while the exposed portion is removed, as shown in FIG. 5G.

As shown in FIG. 5H, a positive-type photoresist is further applied to the entire surface of the substrate 110 having the passage forming layer 120 and the first sacrificial layer 123 to a predetermined thickness by spin-coating, thereby forming a second sacrificial layer 124. The top surface of the second sacrificial layer 124 can be planarized by the first sacrificial layer 123 filling the space surrounded by the passage forming layer 120.

As shown in FIG. 5I, the second sacrificial layer 124 is exposed to UV light using the second photomask 162 used to expose the first sacrificial layer 123. Subsequently, the second sacrificial layer 124 is developed to remove an exposed portion of the second sacrificial layer 124. Then, as shown in FIG. 5J, the sacrificial layer S consisting of the first sacrificial layer 123 and the second sacrificial layer 124 and having the planarized top surface is formed in a space surrounded by the passage forming layer 120.

As shown in FIG. 5K, the sacrificial layer S is then exposed to UV light. Here, the exposing may be performed by blank exposure without using a photomask. The exposure may be continuously performed until the top surface of the sacrificial layer S becomes the same as that of the passage forming layer 120 by controlling an exposure time and light intensity. Next, development is performed to remove the exposed portion of the sacrificial layer S and the height of the sacrificial layer S is lowered, so that the sacrificial layer S has the same height as the passage forming layer 120, as shown in FIG. 5L.

While the foregoing description has shown that the sacrificial layer S is formed by applying, exposing and developing the first sacrificial layer 123, applying, exposing and developing the second sacrificial layer 124, and performing blank exposure and development, the sequence of forming the sacrificial layer S may vary differently from the above. For example, after applying the second sacrificial layer 124, the step of blank exposure can be performed. Subsequently, development may be performed to allow the second sacrificial layer 124 and the first sacrificial layer 123 to remain as high as the passage forming layer 120. Next, the same exposure using the second photomask 162 and development steps are performed, remaining only the sacrificial layer S surrounded by the passage forming layer 120.

Alternatively, the sacrificial layer S may be formed in the following operations. After applying the second sacrificial layer 124, an exposure operation using the second photomask and a blank exposure operation can be performed. Here, the sequence of the two exposing operations may be reversed. Subsequently, the exposed portion is removed by development, so that only the sacrificial layer S surrounded by the passage forming layer 120 remains.

While the foregoing description has shown that the positive-type photoresist is applied twice in order to form a sacrificial layer S having a planarized top surface, applying of the positive-type photoresist may be performed three or more times until the sacrificial layer S has a desired thickness. In this case, the number of times of performing exposure and development increases according to the number of times of applying positive-type photoresist.

Next, as shown in FIG. 5M, a second photoresist layer 131 is formed to the substrate 110 where the passage forming layer 120 and the sacrificial layer S are formed. Since the second photoresist layer 131 forms a nozzle layer (130 of FIG. 50) in a subsequent operation, which will later be described, it is formed of a negative-type photoresist that is chemically stable against ink, like the passage forming layer 120. In particular, the second photoresist layer 131 is formed by applying the negative-type photoresist to an entire surface of the substrate 110 to a predetermined thickness by spin coating. Here, the negative-type photoresist layer 131 may be applied to a thickness enough to obtain a sufficiently long nozzle and to withstand a change in the pressure of the ink chamber.

In the preceding step, since the sacrificial layer S is formed to have substantially the same height as the passage forming layer 120, that is, the top surface of the sacrificial layer S is planarized, it is possible to overcome the deformation or melting problem occurring in the prior art, that is, deformation or melting of edges of the sacrificial layer S due to a reaction between positive-type photoresist forming the sacrificial layer S and the negative-type photoresist forming the second photoresist layer 131. Thus, the second photoresist layer 131 can be perfectly adhered to the passage forming layer 120.

Figure 7A:
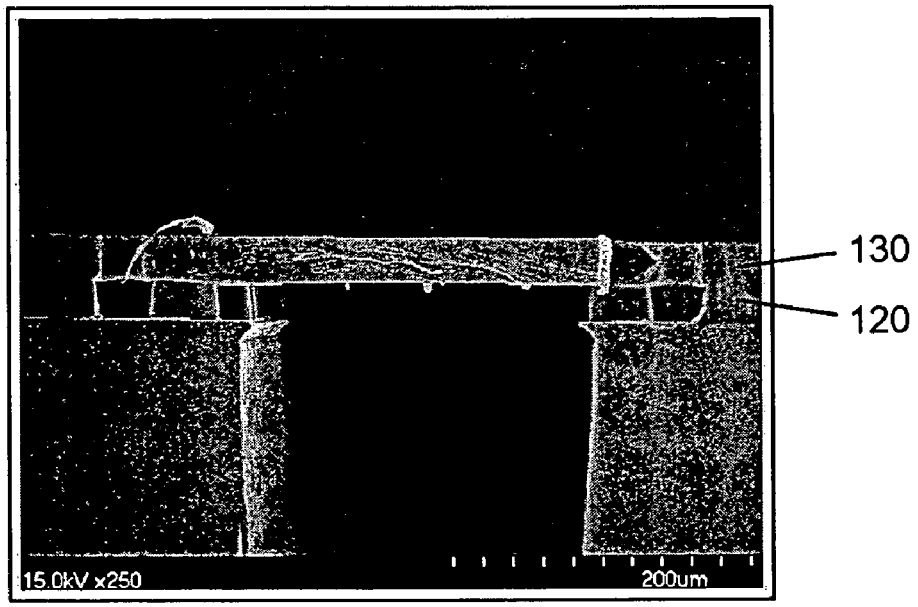
FIG. 7A is a vertical cross-sectional view of an inkjet printhead manufactured using the methods according to the present general inventive concept.
Figure 7B:
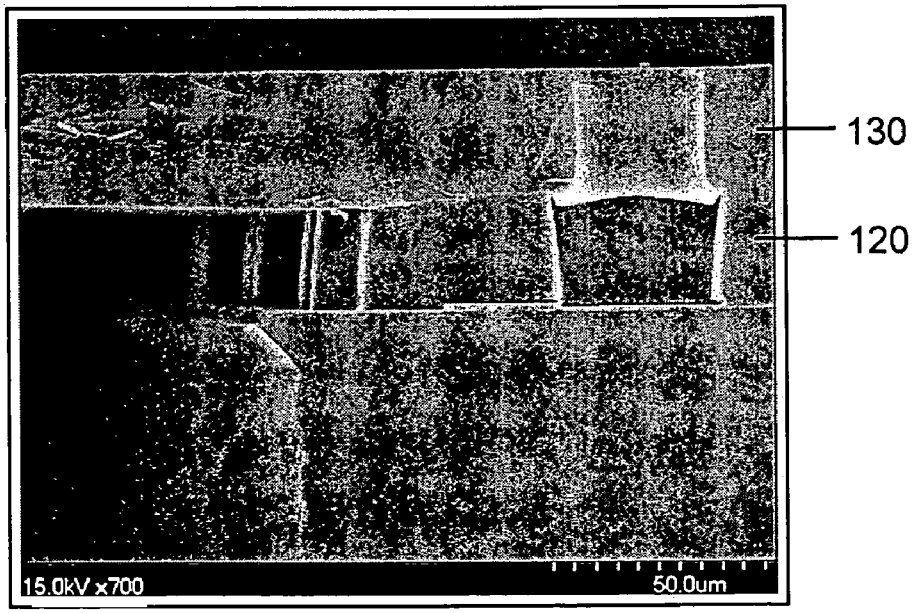
FIG. 7B is an enlarged view of FIG. 7A.

FIGS. 7A and 7B are vertical cross-sectional views of the inkjet printhead manufactured by the method of FIGS. 5A through 5R. Referring to FIG. 7A and FIG. 7B, a cavity is not formed between the passage forming layer 120 and the nozzle layer 130, which suggests that the passage forming layer 120 and the nozzle layer 130 are perfectly adhered to each other.

As shown in FIG. 5N, the second photoresist layer 131 formed of negative-type photoresist is exposed using a third photomask 163 having a nozzle pattern. Subsequently, the second photoresist layer 131 is developed, thereby removing an unexposed portion and forming a nozzle 154, while the exposed, hardened portion remains, forming the nozzle layer 130, as shown in FIG. 50. In the exposing operation, a UV beam of not longer than an I-line radiation (353 nm), or an e-beam or an X-ray having a wavelength shorter than the I-line radiation is preferably used. As described above, exposing by using light having a relatively short wavelength shortens a transmission length of light, so that the sacrificial layer S disposed under the second photoresist layer 131 is not affected by exposure. Thus, nitrogen gas is not generated in the sacrificial layer S formed of positive-type photoresist, thereby avoiding deformation of the nozzle layer 130 due to nitrogen gas, unlike in the prior art.

Figure 8A:
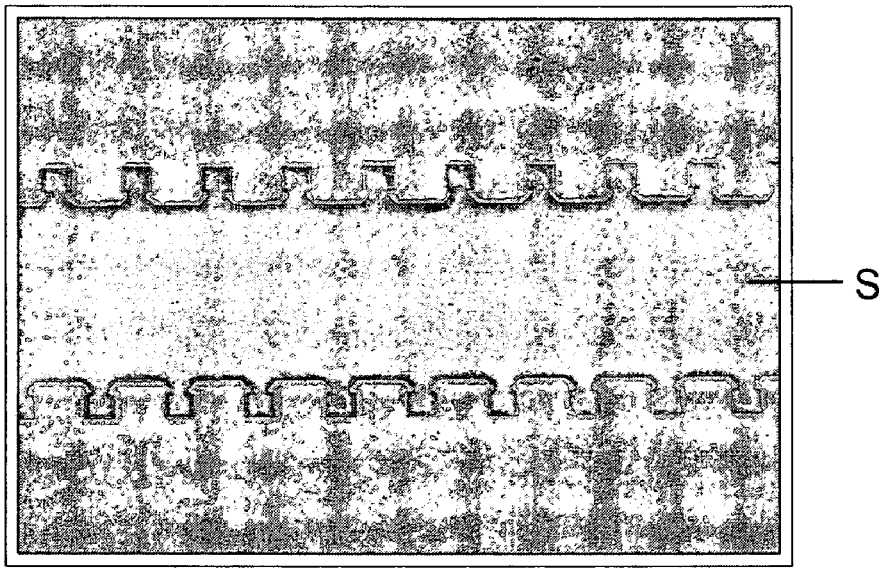
FIG. 8A is a plan view of the inkjet printhead manufactured using the methods according to the present general inventive concept.
Figure 8B:
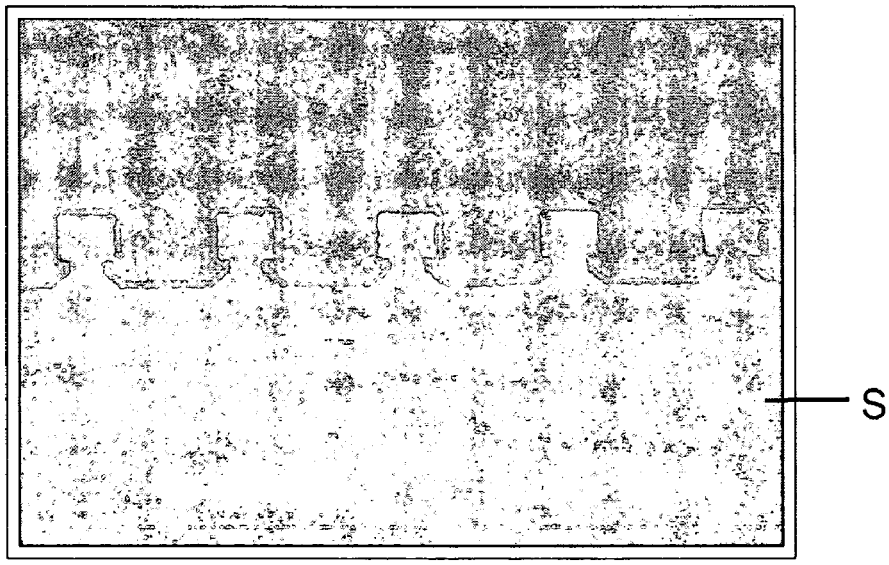
FIG. 8B is an enlarged view of FIG. 8A.

FIGS. 8A and 8B show the inkjet printhead manufactured by the above-described method. Referring to FIGS. 8A and 8B, nitrogen gas is not generated in the sacrificial layer S.

As shown in FIG. 5P, an etch mask 171 that forms an ink supply hole (151 shown in FIG. 5Q 151) is formed on a rear surface of the substrate 110. The etch mask 171 is formed by applying positive- or negative-type photoresist to the rear surface of the substrate 110 and patterning the same.

Next, as shown in FIG. 5Q, the substrate 110 exposed by the etch mask 171 is etched from the rear surface thereof to be perforated, thereby forming an ink supply hole 151, followed by removing the etch mask 171.

More specifically, the etching of the rear surface of the substrate 110 may be performed by dry etching using plasma. Otherwise, the etching of the rear surface of the substrate 110 may be performed by wet etching using tetramethyl ammonium hydroxide (TMAH) or KOH as an etchant.

Finally, the sacrificial layer S is removed using a solvent, thereby forming the ink chamber 153 and the restrictor 152 surrounded by the passage forming layer 120 in a space without the sacrificial layer S, as shown in FIG. 5R.

In such a manner, a monolithic inkjet printhead having the structure shown in FIG. 5R is completed.

FIGS. 6A through 6F are cross-sectional views illustrating a method of manufacturing a monolithic inkjet printhead according to another embodiment of the present general inventive concept. In the following description, the same portions as those in the first embodiment will briefly or not be described.

Figure 6A:
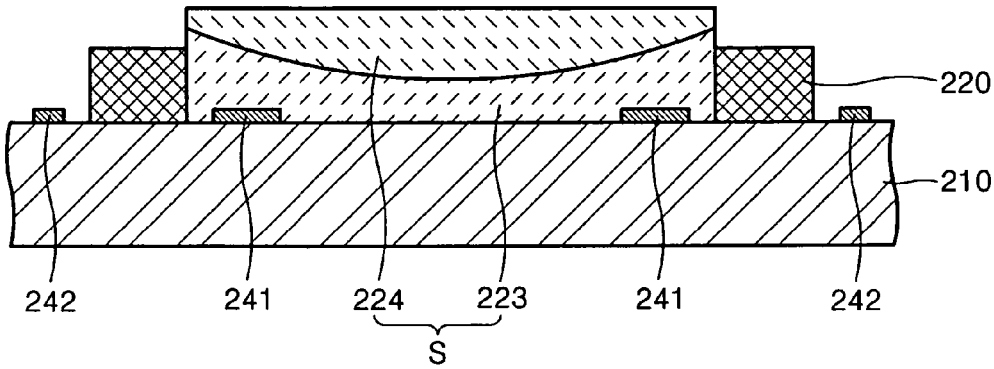
FIGS. 6A through 6F are cross-sectional views illustrating a method of manufacturing a monolithic inkjet printhead according to another embodiment of the present general inventive concept.

In the present embodiment, operations performed until a sacrificial layer S is formed on a substrate 210 are substantially the same as those of the previous embodiment as shown in FIGS. 5A through 5I, which will now be described briefly. As shown in FIG. 6A, a substrate 210 is prepared and a heater 241 that heats ink and an electrode 242 that supplies current to the heater 241 are formed on the substrate 210. Next, a negative-type photoresist is applied to the substrate 210 having the heater 241 and the electrode 242 to a predetermined thickness, followed by exposing and developing, thereby forming a passage forming layer 220. Here, the passage forming layer 220 may be formed to be slightly lower than an ink chamber having a desired height. Then, a positive-type photoresist may be applied to the entire surface of the substrate 210 having the passage forming layer 220 to a predetermined thickness by spin-coating, thereby forming a first sacrificial layer 223 and patterning the same through exposure and development. Subsequently, the positive-type photoresist may be further applied to the entire surface of the substrate 210 to a predetermined thickness by spin-coating, thereby forming a second sacrificial layer 224 and patterning the same through exposure and development. In such a manner, a sacrificial layer S consisting of the first and second sacrificial layers 123 and 124 and having a planarized top surface is formed in a space surrounded by the passage forming layer 220, as shown in FIG. 6A.

When forming the sacrificial layer S according to this embodiment, imide-based positive-type photoresist is used as the positive-type photoresist, and blank exposure and development operations are not performed, the operations of making the height of the sacrificial layer S equal to that of the passage forming layer 220. The imide-based positive-type photoresist requires to be subjected to hard baking at approximately 140° after being developed, while not affected by a solvent contained in the negative-type photoresist and not generating nitrogen gas even by exposure, which will later be described in more detail.

Figure 6B:
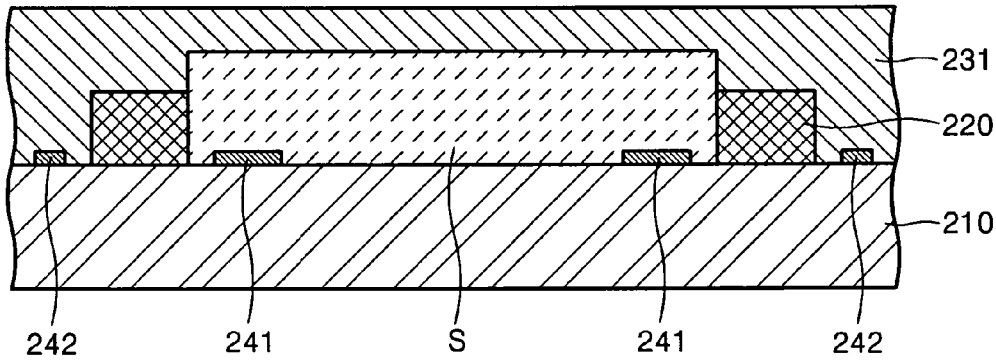

As shown in FIG. 6B, a second photoresist layer 231 is formed on the substrate 210 having the passage forming layer 220 and the sacrificial layer S. Since the second photoresist layer 231 forms a nozzle layer (230 of FIG. 6D) in a subsequent operation, which will later be described, it is formed of a negative-type photoresist that is chemically stable against ink. Specific operations of forming the second photoresist layer 231 are the same as those of the previous embodiment.

In this illustrative embodiment, the sacrificial layer S is formed to protrude higher than the passage forming layer 220. However, since the sacrificial layer S is formed of imide-based positive-type photoresist, it is not affected by a solvent contained in the negative-type photoresist forming the second photoresist layer 231, as described above. Thus, unlike in the prior art, the deformation or melting problem occurring at edges of the sacrificial layer S can be avoided.

Figure 6C:
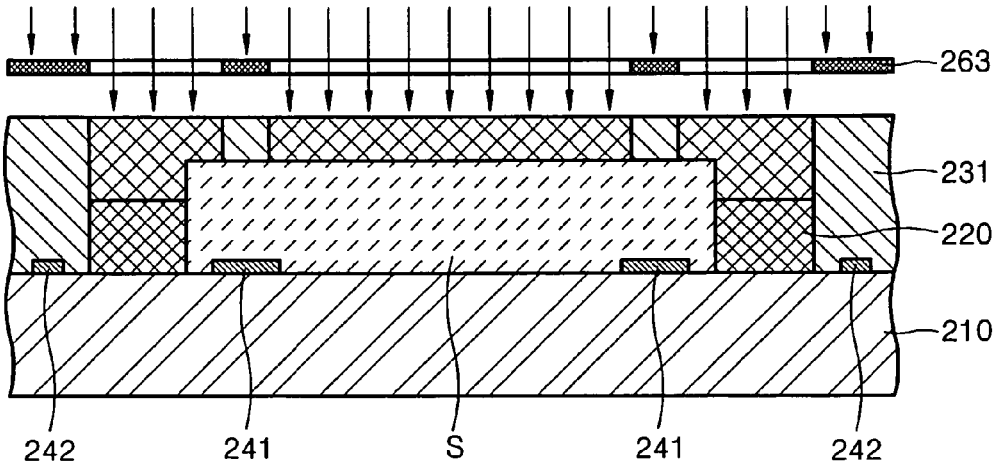
Figure 6D:
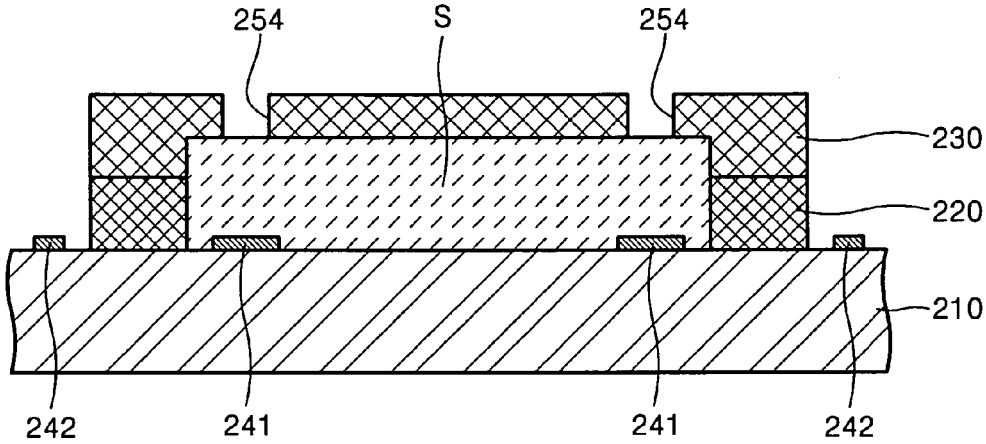

Next, as shown in FIG. 6C, the second photoresist layer 231 formed of the negative-type photoresist is exposed using a photomask 263 having a nozzle pattern. Subsequently, the second photoresist layer 231 is developed, thereby removing an unexposed portion and forming a nozzle 254, while the exposed, hardened portion remains, forming the nozzle layer 230, as shown in FIG. 6D.

In this illustrative embodiment, since the imide-based positive-type photoresist forming the sacrificial layer S does not produce nitrogen gas even by exposure, the deformation problem of the nozzle layer 230 due to nitrogen gas, like in the prior art, does not occur. Thus, in the exposing operation, a UV beam over a broadband, including an I-line radiation (353 nm), an H-line radiation (405 nm) and a G-line radiation (436 nm), or an e-beam or an X-ray having wavelengths shorter than the broadband radiations may be used.

Figure 6E:
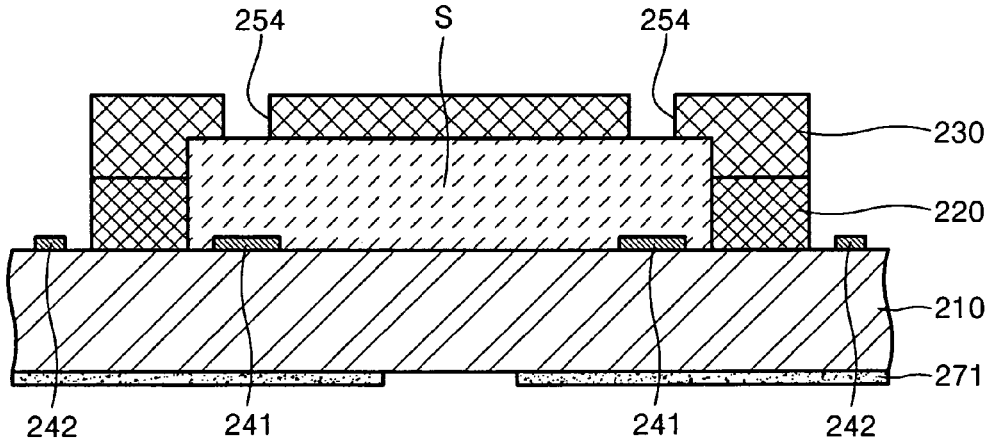

As shown in FIG. 6E, an etch mask 271 is formed on a rear surface of the substrate 210, the substrate 210 exposed by the etch mask 271 is etched from the rear surface thereof to be perforated by dry etching or wet etching, thereby forming an ink supply hole 251.

Specific operations of forming the etch mask 271 and the ink supply hole 251 are the same as those of the previous embodiment.

Figure 6F:
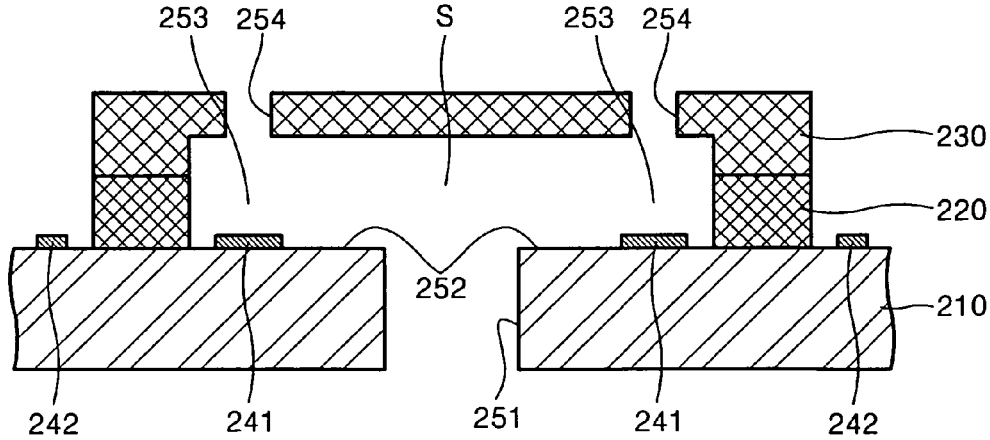

Finally, the sacrificial layer S is removed using a solvent, thereby forming the ink chamber 253 and the restrictor 252 surrounded by the passage forming layer 220 in a space without the sacrificial layer S, as shown in FIG. 6F.

In such a manner, a monolithic inkjet printhead having the structure shown in FIG. 6F is completed.

As described above, according to the method of manufacturing the monolithic ink-jet printhead of the present general inventive concept, since the top surface of the sacrificial layer is planarized, it is possible to overcome the deformation or melting problem occurring in the prior art, that is, deformation or melting of edges of the sacrificial layer S due to a reaction between positive-type photoresist and negative-type photoresist. Thus, the shape and dimension of the ink passage can be easily controlled, thereby improving the uniformity of the ink passage, ultimately improving ink ejection performance of the inkjet printhead. Also, since the passage forming layer and the nozzle layer are perfectly adhered to each other, durability of the printhead is enhanced.

Further, according to the present general inventive concept, since gas is not generated in the sacrificial layer during photography for forming a nozzle, deformation of the nozzle layer due to gas can be avoided. Accordingly, uniformity of the ink passage can be further enhanced.

Although a few exemplary embodiments of the present general inventive concept have been shown and described, it would be appreciated by those skilled in the art that changes may be made in this embodiment without departing from the principles and spirit of the general inventive concept, the scope of which is define in the claims and their equivalents. For example, the elements of the printhead according to the present general inventive concept may be formed of different materials, which are not mentioned in the specification. In addition, the methods of depositing materials and forming elements suggested above are provided only for exemplary illustration. Various deposition methods and etching methods may be employed within the scope of the present general inventive concept. Therefore, the spirit and scope of the invention are defined by the appended claims.

What is claimed is:

1. A method of manufacturing a monolithic inkjet printhead, the method comprising:

forming an ink heating member on a substrate to heat ink;

forming a passage forming layer that surrounds an ink passage by applying a negative-type photoresist pattern to the substrate;

forming a sacrificial layer having a planarized top surface in a space surrounded by the passage forming layer by repeatedly applying a positive-type photoresist pattern to the substrate having the passage forming layer;

forming a nozzle layer having a nozzle by applying a negative-type photoresist pattern to the passage forming layer and the sacrificial layer;

perforating a bottom portion of the substrate to form an ink supply hole; and removing the sacrificial layer.

2. The method of claim 1, wherein each of the positive-type photoresist patterns is formed by a photolithography process.

3. The method of claim 1, wherein the perforating of the bottom portion of the substrate is performed by an etching process.

4. The method of claim 1, wherein the forming of the passage forming layer comprises:

applying a first negative-type photoresist layer on an entire surface of the substrate;

exposing the first photoresist layer in an ink passage pattern; and removing the non-exposed portions of the first photoresist layer.

5. The method of claim 4, wherein the ink passage pattern is formed using a first photomask.

6. The method of claim 1, wherein the sacrificial layer is formed to have substantially the same height as the passage forming layer.

7. The method of claim 6, wherein the forming of the sacrificial layer comprises:

applying a first positive-type photoresist layer on the entire surface of the substrate having the passage forming layer;

exposing portions of the first positive-type photoresist layer in an ink passage pattern;

removing the exposed portions of the first positive-type photoresist layer;

applying a second positive-type photoresist layer to the entire surface of the substrate having the passage forming layer and the first positive-type photoresist layer;

exposing portions the second positive-type photoresist layer in an ink passage pattern;

removing the exposed portions of the second positive-type photoresist layer;

blank-exposing the second positive-type photoresist layer and the first positive-type photoresist layer to have the same height as that of the passage forming layer; and removing the exposed portions of the second positive-type photoresist layer and the first positive-type photoresist layer.

8. The method of claim 7, wherein the ink passage pattern is formed using a second photomask.

9. The method of claim 6, wherein the forming of the sacrificial layer comprises:

applying a first positive-type photoresist layer to the entire surface of the substrate having the passage forming layer;

exposing portions the first positive-type photoresist layer in an ink passage pattern;

removing the exposed portions of the first positive-type photoresist layer layer;

applying a second positive-type photoresist layer to the entire surface of the substrate having the passage forming layer and the first positive-type photoresist layer;

blank-exposing the second positive-type photoresist layer and the first positive-type photoresist layer to have the same height of the passage forming layer;

removing exposed portions of the second positive-type photoresist layer and the first positive-type photoresist layer;

exposing portions of the second positive-type photoresist layer in an ink passage pattern; and removing the exposed portions of the second positive-type photoresist layer.

10. The method of claim 9, wherein the ink passage pattern is formed using a second photomask.

11. The method of claim 6, wherein the forming of the sacrificial layer comprises:

applying a first positive-type photoresist layer to the entire surface of the substrate having the passage forming layer;

exposing portions of the first positive-type photoresist layer in an ink passage pattern;

removing the exposed portions of the first positive-type photoresist layer;

applying a second positive-type photoresist layer to the entire surface of the substrate having the passage forming layer and the first positive-type photoresist layer;

exposing portions of the second positive-type photoresist layer in an ink passage pattern;

blank-exposing the second positive-type photoresist layer and the first positive-type photoresist layer to have the same height as that of the top surface of the passage forming layer; and removing the exposed portions of the second positive-type photoresist layer and the first positive-type photoresist layer.

12. The method of claim 11, wherein the ink passage pattern is formed using a second photomask.

13. The method of claim 6, wherein the forming of the sacrificial layer comprises:

applying a first positive-type photoresist layer to the entire surface of the substrate having the passage forming layer;

exposing portions of the first positive-type photoresist layer in an ink passage pattern;

removing the exposed portions the first positive-type photoresist layer;

applying a second positive-type photoresist layer to the entire surface of the substrate having the passage forming layer and the first positive-type photoresist layer;

blank-exposing the second positive-type photoresist layer and the first positive-type photoresist layer to have the same height as that of the top surface of the passage forming layer;

exposing the second positive-type photoresist layer in an ink passage pattern; and removing the exposed portions of the second positive-type photoresist layer and the first positive-type photoresist layer.

14. The method of claim 13, wherein the ink passage pattern is formed using a second photomask.

15. The method of claim 1, wherein the applying of the positive-type photoresist is performed by spin coating.

16. The method of claim 1, wherein the sacrificial layer is formed using an imide-based positive-type photoresist to have a height greater than the passage forming layer.

17. The method of claim 15, wherein the forming of the sacrificial layer comprises:

applying a first imide-based positive-type photoresist layer to the entire surface of the substrate having the passage forming layer;

exposing portions of the first sacrificial layer in an ink passage pattern;

removing the exposed portions of the first imide-based positive-type photoresist layer;

applying an second imide-based positive-type photoresist layer to the entire surface of the substrate having the passage forming layer and the first imide-based positive-type photoresist layer;

exposing portions of the second imide-based positive-type photoresist layer in an ink passage pattern; and removing the exposed portions of the second sacrificial layer.

18. The method of claim 17, wherein the ink passage pattern is formed using a second photomask.

19. The method of claim 17, wherein the applying of the imide-based positive-type photoresist is performed by spin coating.

20. The method of claim 1, wherein the forming of the nozzle layer comprises:

applying a second negative-type photoresist layer to the passage forming layer and the sacrificial layer;

exposing portions of the second negative-type photoresist layer in a nozzle pattern; and removing the unexposed portions the second negative-type photoresist layer to form a nozzle and a nozzle layer.

21. The method of claim 20, wherein the nozzle pattern is formed using a third photomask.

22. The method of claim 20, wherein in the exposing of the second photoresist layer, a UV beam not longer than an I-line radiation, an e-beam, or an X-ray is used.

23. The method of claim 1, wherein the etching the substrate comprises:

applying a photoresist layer to a rear surface of the substrate;

patterning the photoresist in the ink supply hole form; and etching the rear surface of the substrate at the ink supply hole form to form an ink supply hole.

24. The method of claim 23, wherein the ink supply hole form is formed by using an etch mask.

25. The method of claim 23, wherein the etching of the rear surface of the substrate is performed by dry etching using plasma.

26. The method of claim 23, wherein the etching of the rear surface of the substrate is performed by wet etching using TMAH or KOH.

* * * * *